US006464226B1

(12) United States Patent
Kephart

(10) Patent No.: US 6,464,226 B1
(45) Date of Patent: Oct. 15, 2002

(54) WASHER TOSS GAME AND METHOD OF PLAYING THE SAME

(76) Inventor: Austin R. Kephart, 80 Church St., Springville, NY (US) 14141

( * ) Notice: Subject to any disclaimer, the term of this patent is extended or adjusted under 35 U.S.C. 154(b) by 0 days.

(21) Appl. No.: 09/797,620

(22) Filed: Mar. 5, 2001

(51) Int. Cl.[7] ..... A63B 67/06
(52) U.S. Cl. ..... 273/401
(58) Field of Search ..... 273/398, 400, 273/402, 401, 285–287; 473/162, 278

(56) References Cited

U.S. PATENT DOCUMENTS

| | | | | | |
|---|---|---|---|---|---|
| 406,342 | A | * | 7/1889 | Dumont | 273/402 |
| 3,815,915 | A | | 6/1974 | Chapman | |
| 4,243,229 | A | | 1/1981 | Huser et al. | |
| 4,927,161 | A | * | 5/1990 | Brenneman | 273/402 |
| 4,936,590 | A | | 6/1990 | Palmer | |
| 4,974,858 | A | * | 12/1990 | Knowlton | 273/401 |
| 4,982,966 | A | | 1/1991 | Teafatille | |
| 5,042,813 | A | * | 8/1991 | Huang | 473/153 |
| 5,316,310 | A | * | 5/1994 | Nicholas et al. | 273/317 |
| 5,472,211 | A | * | 12/1995 | McCaughan | 273/401 |
| 5,575,480 | A | * | 11/1996 | Wehr | 273/402 |
| D406,179 | S | | 2/1999 | Thompson et al. | |

* cited by examiner

*Primary Examiner*—Mark S. Graham

(57) ABSTRACT

A washer toss game and the method of playing the same for providing entertainment and exercise for the user. The washer toss game and the method of playing the same includes a plurality of game boards each having a first board member and a second board member being connected to the first board member with each of the board members further having a top side and a plurality of holes disposed in the top side and numbers displayed upon the top side adjacent to the holes; and also includes a plurality of washer members for tossing upon the game boards and into the holes from a determined distance.

15 Claims, 2 Drawing Sheets

WASHER TOSS GAME AND METHOD OF PLAYING THE SAME

BACKGROUND OF THE INVENTION

1. Field of the Invention

The present invention relates to a washer pitching game and more particularly pertains to a new washer toss game and the method of playing the same for providing entertainment and exercise for the user.

2. Description of the Prior Art

The use of a washer pitching game is known in the prior art. More specifically, a washer pitching game heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,936,590; 4,974,858; 3,815,915; U.S. Pat. No. Des. 406,179; U.S. Pat. Nos. 4,982,966; and 4,243,229.

While these devices fulfill their respective, particular objectives and requirements, the aforementioned patents do not disclose a new washer toss game and the method of playing the same. The inventive device includes a plurality of game boards each having a first board member and a second board member being connected to the first board member with each of the board members further having a top side and a plurality of holes disposed in the top side and numbers displayed upon the top side adjacent to the holes; and also includes a plurality of washer members for tossing upon the game boards and into the holes from a determined distance.

In these respects, the washer toss game and the method of playing the same according to the present invention substantially departs from the conventional concepts and designs of the prior art, and in so doing provides an apparatus primarily developed for the purpose of providing entertainment and exercise for the user.

SUMMARY OF THE INVENTION

In view of the foregoing disadvantages inherent in the known types of washer pitching game now present in the prior art, the present invention provides a new washer toss game and the method of playing the same construction wherein the same can be utilized for providing entertainment and exercise for the user.

The general purpose of the present invention, which will be described subsequently in greater detail, is to provide a new washer toss game and the method of playing the same which has many of the advantages of the washer pitching game mentioned heretofore and many novel features that result in a new washer toss game and the method of playing the same which is not anticipated, rendered obvious, suggested, or even implied by any of the prior art washer pitching game, either alone or in any combination thereof.

To attain this, the present invention generally comprises a plurality of game boards each having a first board member and a second board member being connected to the first board member with each of the board members further having a top side and a plurality of holes disposed in the top side and numbers displayed upon the top side adjacent to the holes; and also includes a plurality of washer members for tossing upon the game boards and into the holes from a determined distance.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new washer toss game and the method of playing the same which has many of the advantages of the washer pitching game mentioned heretofore and many novel features that result in a new washer toss game and the method of playing the same which is not anticipated, rendered obvious, suggested, or even implied by any of the prior art washer pitching game, either alone or in any combination thereof.

It is another object of the present invention to provide a new washer toss game and the method of playing the same which may be easily and efficiently manufactured and marketed.

It is a further object of the present invention to provide a new washer toss game and the method of playing the same which is of a durable and reliable construction.

An even further object of the present invention is to provide a new washer toss game and the method of playing the same which is susceptible of a low cost of manufacture with regard to both materials and labor, and which accordingly is then susceptible of low prices of sale to the consuming public, thereby making such washer toss game and the method of playing the same economically available to the buying public.

Still yet another object of the present invention is to provide a new washer toss game and the method of playing the same which provides in the apparatuses and methods of the prior art some of the advantages thereof, while simultaneously overcoming some of the disadvantages normally associated therewith.

Still another object of the present invention is to provide a new washer toss game and the method of playing the same for providing entertainment and exercise for the user.

Yet another object of the present invention is to provide a new washer toss game and the method of playing the same which includes a plurality of game boards each having a first board member and a second board member being connected attached to the first board member with each of the board members further having a top side and a plurality of holes disposed in the top side and numbers displayed upon the top side adjacent to the holes; and also includes a plurality of washer members for tossing upon the game boards and into the holes from a determined distance.

Still yet another object of the present invention is to provide a new washer toss game and the method of playing the same that improves the user's hand-eye coordination.

Even still another object of the present invention is to provide a new washer toss game and the method of playing the same that is challenging and fun for all ages and is easy to understand by anyone.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
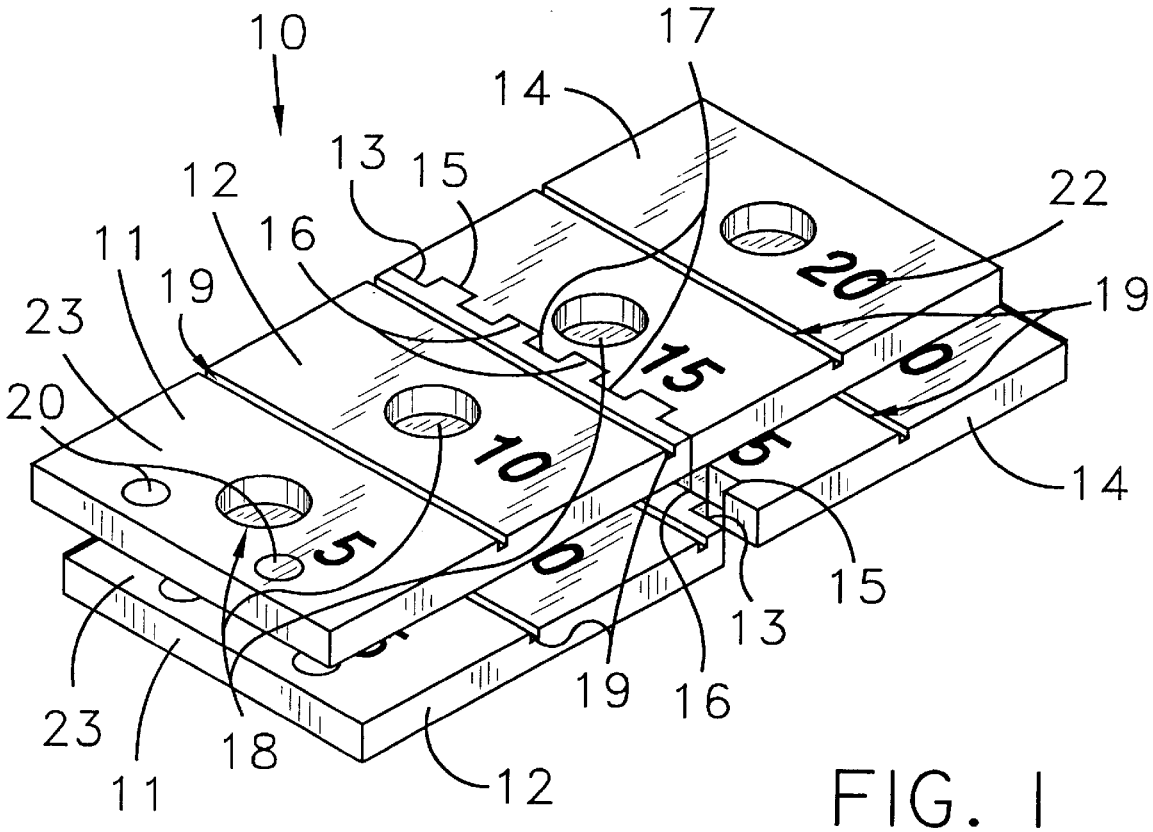
FIG. 1 is a perspective view of a new washer toss game and the method of playing the same according to the present invention.
Figure 2:
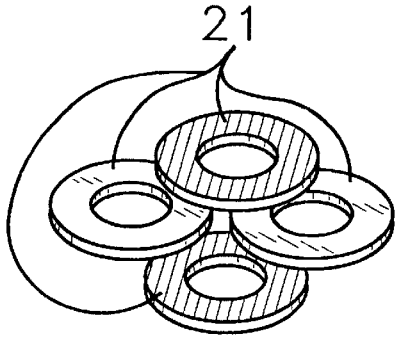
FIG. 2 is a perspective view of the washer members of the present invention.
Figure 3:
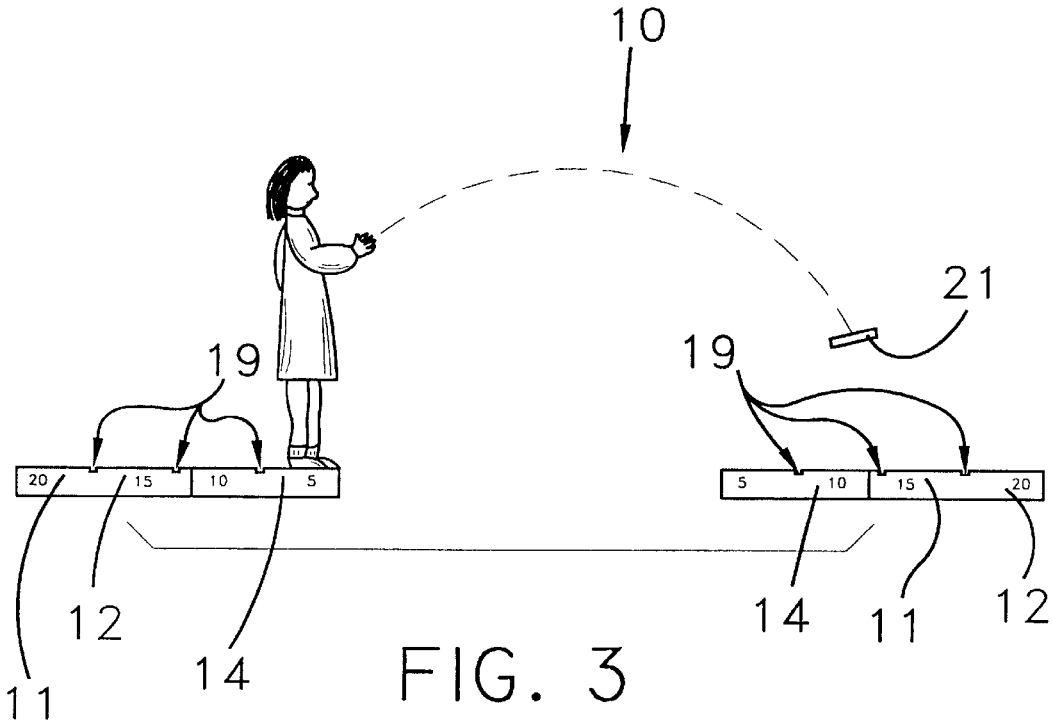
FIG. 3 is a side elevational view of the present invention shown being used.

With reference now to the drawings, and in particular to FIGS. 1 through 3 thereof, a new washer toss game and the method of playing the same embodying the principles and concepts of the present invention and generally designated by the reference numeral 10 will be described.

As best illustrated in FIGS. 1 through 3, the washer toss game and the method of playing the same 10 generally comprises a plurality of game boards 11 each having a first board member 12 and a second board member 14 being conventionally connected to the first board member 12. Each of the board members 12,14 further has a top side 23 and a plurality of holes 18 disposed in the top side 23 and numbers 22 displayed upon the top side 23 adjacent to the holes. Each first board member 12 includes an upper end edge 13 having first teeth-like members 16 being spaced apart and being securely and conventionally disposed therein and extending outwardly therefrom. Each second board member 14 includes a lower end edge 15 having second teeth-like members 17 being spaced apart and being securely and conventionally disposed therein and extending outwardly therefrom. The first teeth-like members 16 are engaged to the second teeth-like members 17 for removably attaching the first board members 12 to the second board members 14. Each first board member 12 is removably attached end-to-end with a respective second board member 14. Each of the game boards 11 includes a plurality of grooves 19 being disposed in the top side 23 and extending laterally of the game board 11. The grooves 19 essentially separate the game boards 11 into distinctive sections with each section having a respective hole 18. The game boards 11 are adapted to be placed upon a ground surface and are adapted to be spaced from one another at a pre-determined distance. Each of the game boards 11 has a length of approximately 42 inches and a width of approximately 17 inches and a depth of approximately 2 inches.

The washer toss game 10 further includes a plurality of washer members 21 for tossing upon the game boards 11 and into the holes 18 from a determined distance with the holes 18 of the first game board 12 and the holes 18 of second board member 14 being essentially aligned in a row. The holes 18 are adapted to receive the washer members 21 with the holes 18 being disposed intermediate of side edges of the game boards 11. Each of the holes 18 represents a pre-determined point value. Each of the numbers 22 represents a respective pre-determined point value. Each of the game boards 11 further includes markings 20 conventionally displayed upon the top side 23 of the second board member 14 near an upper end edge thereof with the markings 20 being adapted to identify a location upon where a user is to stand while tossing the washer members 21 to another of the game boards 11.

In use, the user sets up game boards 11 upon a ground surface with the game boards 11 being spaced from one another at a pre-determined distance. The user then stands upon an opponent's game board 11, and tosses the washer members 21 onto one's own game board 11, and then totals the point values of the washer members 21 being disposed in corresponding holes 18. The user stands along an edge the opponent's game board 11 closet to one's own game board 11. First player who scores 100 points wins the game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A washer toss game comprising:

a plurality of game boards each comprising a first board member and a second board member, wherein each of said second board members are releasably attachable to a respective one of said first board members, each of said board members further having a top side and a plurality of holes extending therethrough and numbers positioned upon said top side adjacent to said holes;

a plurality of washer members for tossing upon said game boards and into said holes from a pre-determined distance; and wherein each of said game boards includes a plurality of grooves disposed in said top side and extending laterally of said game board, said grooves essentially separating said top side of each of said game boards into distinctive sections with each of said sections having a respective one of said holes.

2. A washer toss game as described in claim 1 wherein each said first board member includes an upper end edge having first teeth-like members being spaced apart and being securely disposed therein and extending outwardly therefrom.

3. A washer toss game as described in claim 2, wherein each said second board member includes a lower end edge having second teeth-like members being spaced apart and being securely disposed therein and extending outwardly therefrom, said first teeth-like members being engagable to said second teeth-like members for removably attaching said first board members to said second board members.

4. A washer toss game as described in claim 1, wherein each said first board member being removably attached end-to-end with a respective second board member.

5. A washer toss game as described in claim 1, wherein said holes of said first game board and said holes of second board member are essentially aligned in a row, said holes being adapted to receive said washer members.

6. A washer toss game as described in claim 1, wherein said holes are disposed intermediate of side edges of said game boards, each of said holes representing a pre-determined point value, each of said numbers representing a respective said pre-determined point value.

7. A washer toss game as described in claim 1, wherein each of said game boards are adapted to be placed upon a ground surface and positioned a pre-determined distance apart.

8. A washer toss game as described in claim 7, wherein each of said game boards further includes markings displayed upon said top side of each of said second board members near an upper end edge thereof, said markings being adapted to identify a location upon where a user is to stand while tossing said washer members to another of said game boards.

9. A washer toss game comprising:

a plurality of game boards each having a first board member and a second board member being connected to said first board member, each of said board members further having a top side and a plurality of holes disposed in said top side and numbers displayed upon said top side adjacent to said holes;

a plurality of washer members for tossing upon said game boards and into said holes from a determined distance;

wherein each said first board member includes an upper end edge having first teeth-like members being spaced apart and being securely disposed therein and extending outwardly therefrom;

wherein each said second board member includes a lower end edge having second teeth-like members being spaced apart and being securely disposed therein and extending outwardly therefrom, said first teeth-like members being engaged to said second teeth-like members for removably attaching said first board members to said second board members;

wherein each said first board member being removably attached end-to-end with a respective second board member;

wherein said holes of said first game board and said holes of second board member are essentially aligned in a row, said holes being adapted to receive said washer members; and wherein each of said game boards includes a plurality of grooves disposed in said top side and extending laterally of said game board, said grooves essentially separating each of said game boards into distinctive sections with each of said sections having a respective one of said holes.

10. A washer toss game as described in claim 9, wherein said holes are disposed intermediate of side edges of said game boards, each of said holes representing a pre-determined point value, each of said numbers representing a respective said pre-determined point value.

11. A washer toss game as described in claim 9, wherein each of said game boards are adapted to be placed upon a ground surface and positioned a pre-determined distance apart.

12. A washer toss game as described in claim 11, wherein each of said game boards further includes markings displayed upon said top side of each of said second board members near an upper end edge thereof, said markings being adapted to identify a location upon where a user is to stand while tossing said washer members to another of said game boards.

13. A washer toss game comprising:

a plurality of game boards each having a first board member and a second board member being connected to said first board member, each of said board members further having a top side and a plurality of holes disposed in said top side and numbers displayed upon said top side adjacent to said holes, each said first board member including an upper end edge having first teeth-like members being spaced apart and being securely disposed therein and extending outwardly therefrom, each said second board member including a lower end edge having second teeth-like members being spaced apart and being securely disposed therein and extending outwardly therefrom, said first teeth-like members being engaged to said second teeth-like members for removably attaching said first board members to said second board members, each said first board member being removably attached end-to-end with a respective second board member, each of said game boards including a plurality of grooves disposed in said top side and extending laterally of said game board, said grooves essentially separating said game boards into distinctive sections with each said section having a respective said hole, said game boards being adapted to placed upon a ground surface and being adapted to be spaced from one another at a pre-determined distance, each of said game boards having a length of approximately 42 inches and a width of approximately 17 inches and a depth of approximately 2 inches; and a plurality of washer members for tossing upon said game boards and into said holes from a determined distance, said holes of said first game board and said holes of second board member being essentially aligned in a row, said holes being adapted to receive said washer members, said holes being disposed intermediate of side edges of said game boards, each of said holes representing a pre-determined point value, each of said numbers representing a respective said predetermined point value, each of said game boards further including markings displayed upon said top side of said second board member near an upper end edge thereof, said markings being adapted to identify a location upon where a user is to stand while tossing said washer members to another of said game boards.

14. A method of playing a washer toss game includes the steps of:

setting up game boards upon a ground surface with said game boards being spaced from one another at a pre-determined distance and with each said game board having a top side and having a plurality of holes spaced apart and disposed in said top side and also having numbers each representing a point value and being displayed adjacent to a respective said hole upon said top side, each of said game boards including a plurality of grooves disposed in said top side and extending laterally of said game board, said grooves essentially separating said top side of each of said game boards into distinctive sections with each said sections having a respective one of said holes;

standing upon an opponent's said game board;

tossing washer members onto one's said game board; and totaling said point values of said washer members being disposed in corresponding said holes.

15. A method of playing the washer toss game as described in claim 14 wherein said step of standing upon an opponent's said game board includes standing along an edge of said opponent's said game board that is located closest to one's said game board.

* * * * *